United States Patent [19]

Airey et al.

[11] Patent Number: 4,844,159

[45] Date of Patent: Jul. 4, 1989

[54] LOCKING DEVICE FOR SECURING A TOOL IN A WELL CONDUIT

[75] Inventors: Peter J. Airey, Vulaines-sur-Seine, France; Bernard Doremus, Missouri, Tex.

[73] Assignee: Schlumberger Technology Corporation, New York, N.Y.

[21] Appl. No.: 198,235

[22] Filed: May 25, 1988

[30] Foreign Application Priority Data

May 25, 1987 [FR] France ..... 87 07340

[51] Int. Cl.[4] ..... E21B 23/02

[52] U.S. Cl. ..... 166/214; 166/382; 166/385

[58] Field of Search ..... 166/123, 124, 125, 136, 166/137, 206, 207, 214, 217, 382, 83, 385

[56] References Cited

U.S. PATENT DOCUMENTS

| | | | |
|---|---|---|---|
| 2,605,843 | 8/1952 | Baker | 166/125 |
| 2,894,586 | 7/1959 | Schramm et al. | 166/125 |
| 2,976,931 | 3/1961 | Daffin | 166/125 |
| 3,330,341 | 7/1967 | Jackson, Jr. et al. | 166/136 X |
| 4,167,970 | 9/1979 | Cowan | 166/214 X |
| 4,362,211 | 12/1982 | Fisher, Jr. | 166/217 |
| 4,469,173 | 9/1984 | Gilbert et al. | 166/188 |
| 4,554,972 | 11/1985 | Merritt | 166/214 X |
| 4,624,311 | 11/1986 | Goad | 166/125 |
| 4,745,974 | 5/1988 | Higgins | 166/125 X |

*Primary Examiner*—Stephen J. Novosad

*Attorney, Agent, or Firm*—Clifford L. Tager; Keith G. W. Smith

[57] ABSTRACT

The invention is directed to a locking mechanism for locking a tool to an anchor seat located in the tubing of a well, the locking mechanism comprising keys which are radially movable relative to the axis of the tool, the keys emerging via apertures in the body of the tool to engage in a groove of an anchor seat located in the well conduit. The groove of the anchor seat has an internal diameter smaller than the internal diameter of the well conduit. Each key is axially movable within the aperture between a high position and a low position. Structure is provided for retaining the keys in the high position, positioning the keys in a radially retracted position, so that the keys do not cause the tool to be secured in the anchor seat. Structure is also provided for positioning the keys in a radially extended position, causing the keys to contact the groove of the anchor seat, thereby locking the tool to the anchor seat.

15 Claims, 6 Drawing Sheets

LOCKING DEVICE FOR SECURING A TOOL IN A WELL CONDUIT

BACKGROUND OF THE INVENTION

1. Technical Field

The present invention is directed to a locking device for securing an item in a well conduit. More particularly, the present invention is directed to a controllable locking device for securing a tool, such as a logging tool for logging a well, in a well conduit.

As well known to those skilled in the art, a casing is secured to a borehole once production of that borehole is determined. The casing is perforated by any well known technique in order to access the production fluid(s) from the production zones(s). As used herein, the term "well conduit" refers to the tubing located in the casing for conducting the production fluid(s) to the surface of the well.

2. Background Information

Several locking devices for securing a tool in a well conduit and the like are known in the art. For example, U.S. Pat. No. 2,605,843 issued to Baker; U.S. Pat. No. 4,362,211 issued to Fisher; U.S. Pat. No. 4,469,173 issued to Gilbert et. al.; and U.S. Pat. No. 4,554,972 issued to Merritt, all of which are herein incorporated by reference.

SUMMARY OF THE INVENTION

The object of the present invention is to obtain a locking mechanism which is simple in structure and easy to operate and which enables a tool to be locked in all types of anchor seats (e.g., a top stopseat, a bottom stop seat, or a selective seat), the locking being obtainable only in a seat of appropriate size and with it being possible to choose from the various anchor seats of appropriate diameter that may be included in any given conduit.

The present invention is directed to a locking mechanism for locking a tool to an anchor seat located in the tubing of a well, the locking mechanism comprising keys which are radially movable relative to the axis of the tool, the keys emerging via apertures in the body of the tool to engage in a groove of an anchor seat located in the well conduit. The groove of the anchor seat has an internal diameter smaller than the internal diameter of the well conduit. Each key is axially movable within the aperture between a high position and a low position. Structure is provided for retaining the keys in the high position, positioning the keys in a radially retracted position, so that the keys do not cause the tool to be secured in the anchor seat. Structure is also provided for positioning the keys in a radially extended position, causing the keys to contact the groove of the anchor seat, thereby locking the tool to the anchor seat.

Thus, a tool can be locked in an anchor seat only after its keys have been released, and this requires the anchor seat to have a diameter suitable for causing the keys to be pushed a suitable distance towards the axis of the tool, and an upwards motion to be applied to the tool after its keys have come below the groove of the seat in order to bring the keys into the lower position where they are fully released and can then penetrate into said groove in order to be locked therein.

Preferably, the keys are interconnected so that they necessarily move together in translation along the direction of the axis of the tool.

In the preferred embodiment, the retaining means comprises respective abutment elements fixed to the keys, which elements bear against the wall of the tool body above the apertures when the keys are in their high position, thereby maintaining the keys in the retracted position. At least some of the abutment elements include a short stud directed radially outwardly from the tool, the stud retaining the corresponding key in the retracted and high position when engaged in a suitable orifice provided in the wall of the tool body, and being capable of being dislodged therefrom to release said key by the key being pushed in radially and then axially displaced towards its low position.

It is advantageous for the abutment elements and the stud associated with a key to be sufficienlty close thereto for the corresponding aperture to receive the abutment elements and the stud when the key is released and takes up its low position.

In accordance with another characteristic of the invention, the abutment for radially locking each key is capable of taking up, by axial displacement, a preliminary locking position in which it partially overlaps the area of the corresponding aperture in the vicinity of the bottom edge thereof so as to provide partial backing against the abutment for the key when the key is in the low position, and a final locking position in which the key is fully backed against the abutment.

The radial locking abutments are carried on a moving sleeve disposed coaxially inside the body of the tool. They may then either interconnect to form a continuous ring or else they may be distinct, each having a circumferential extent which is less than the gap between the keys. In the first case, the tool is unlocked by causing the sleeve to move downwardly so that the continuous ring is brought below the keys; in the second case unlocking is obtained by rotating the sleeve about the axis until the keys come opposite the gaps between the abutments.

The keys are carried by resilient ribs extending along the axial direction and belonging to a single part which is displaceable along the direction. It is possible for the resilient ribs carrying the keys to be narrower than the keys and that each abutment for radial locking has a central notch running parallel to the axis and suitable for receiving the resilient rib of the corresponding key, but not the key itself. Unlocking is then obtained by moving the sleeve carrying the abutments so that, on leaving the keys, the abutments come opposite the key-carrying ribs, with the abutments being able to radially lock the keys but not the key-carrying ribs. This motion of the sleeve is upwardly directed when the keys are to be found at the bottom ends of the ribs.

DESCRIPTION OF THE PREFERRED EMBODIMENT(S)

Figure 1:
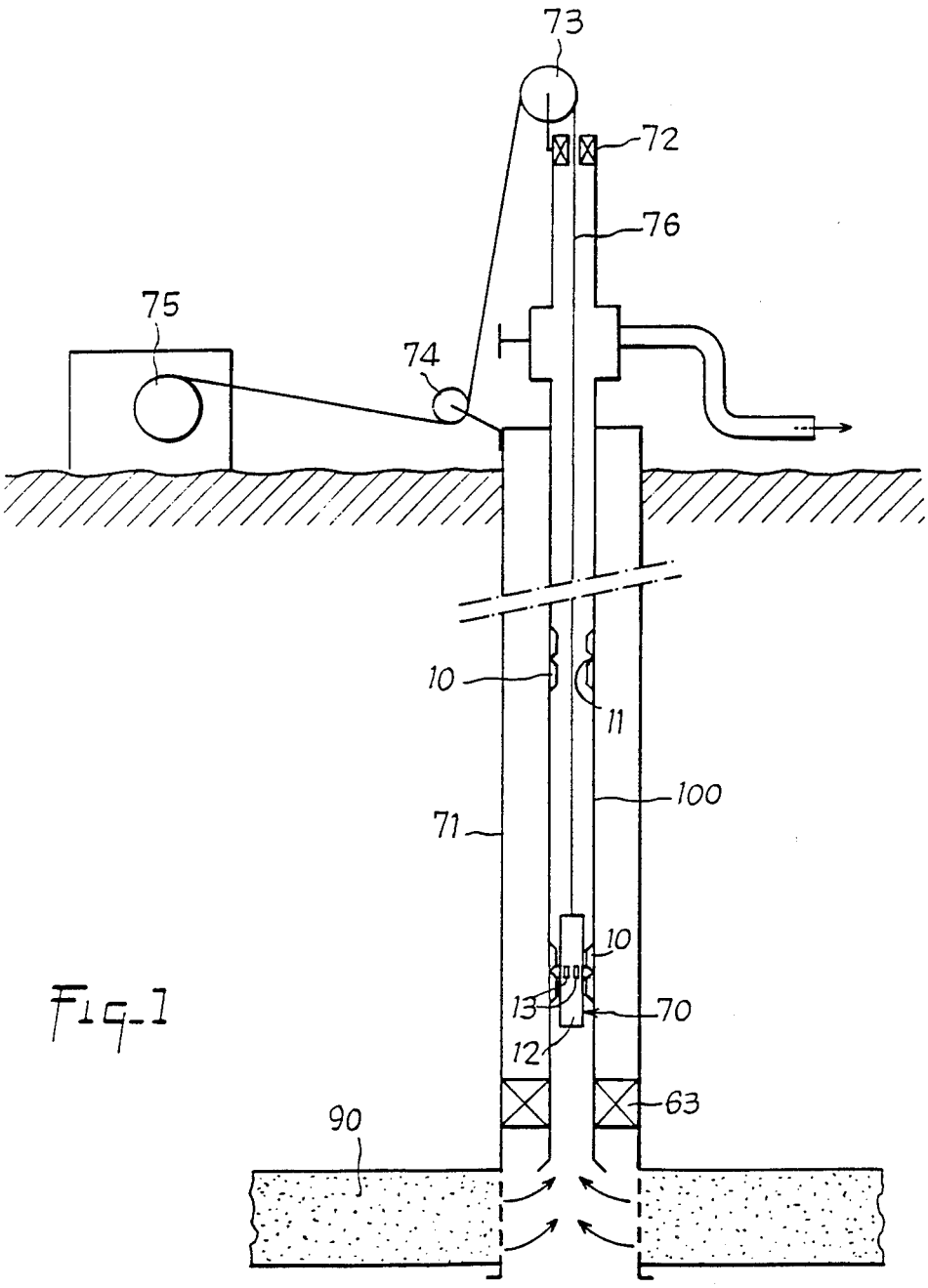
FIG. 1 shows a vertical section of a well illustrating a well conduit provided with two anchor seats, one of which having a tool secured thereto.

Turning now to FIG. 1, a vertical section of a well is shown. Oil producing zone 90 is accessed by well conduit 100 inside perforated casing 71. Annular sealing fitting, or packer, 63 is disposed between the terminal end of conduit 100 and casing 71.

Tool 70, such as one used for logging the well, may be lowered down the conduit by means of cable 76 from which the tool is suspended. The cable emerges from the top of the conduit via sealing means 72 and passes around sheaves 73 and 74 to be wound onto the drum of winch 75 disposed on the surface of the ground.

In the following description of the locking device for locking the tool, it is assumed that the tool is in its normal operating position in a vertical well.

Tool 70 may be positioned temporarily in any one of several anchor seats 10 provided along the length of conduit 100. For clarity, only two anchor seats are shown. It is to be understood, however, that any number of anchor seats may be provided. Each anchor seat preferably comprises a length of tubing incorporated into the conduit for providing an inside diameter smaller than the conduit's inside diameter. Peripheral groove 11 is formed in the wall of the tubing for receiving the locking device of the present invention, as explained in detail herein.

The locking device of the present invention preferably comprises two parts, the key assembly, for securing the tool to the anchor seat, and the key engagement mechanism, for engaging the key mechanism into the anchor seat and disengaging the key mechanism from the anchor seat.

Figure 2:
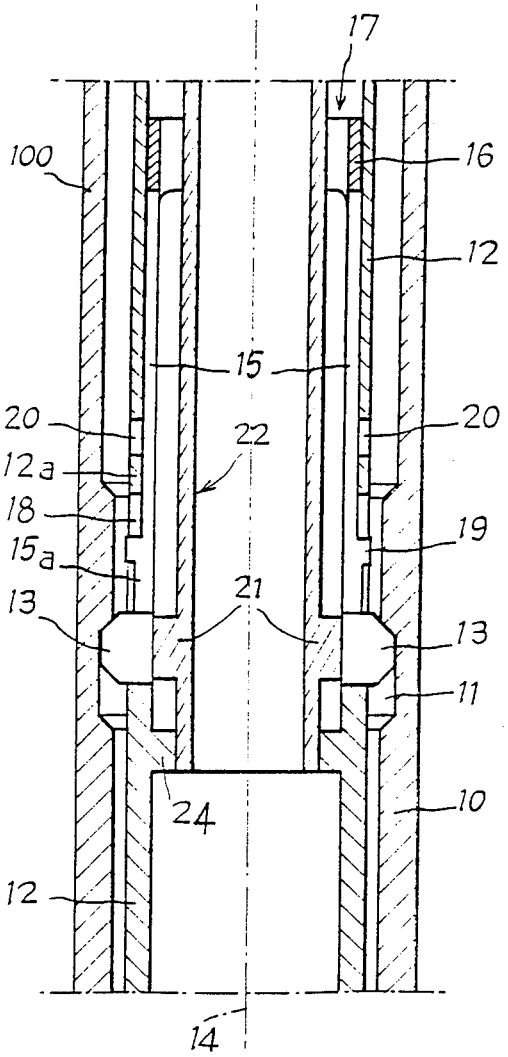
FIG. 2 shows a longitudinal cross-section of the anchor seat and tool of FIG. 1, illustrating the preferred embodiment of the locking device of the present invention.
Figure 3:
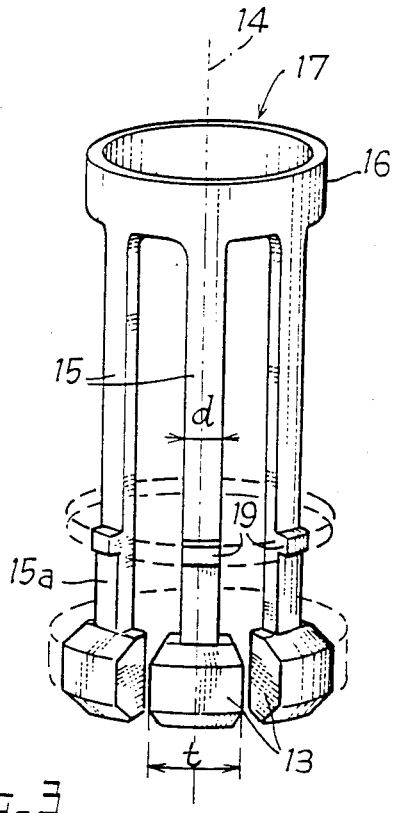
FIG. 3 is a perspective view of the key assembly of FIG. 2.

As shown in FIGS. 2 and 3, key assembly 17 preferably comprises multiple pairs of diametrically opposed locking keys 13 which are symmetrically distributed about axis 14. Each locking key 13 is attached to annular base 16 by rib 15. Ribs 15 are resiliently deformable so as to enable keys 13 to move radially relative to axis 14. Each rib 15 preferably includes studs 19. Optionally, only some of the ribs may be provided with a stud, e.g. every other rib.

Key assembly 17 is engaged in tubular body 12 of the tool and is capable of sliding longitudinally therein in the direction of axis 14. Locking keys 13 emerge from the outside of tubuluar body 12 via apertures 18, which are larger than locking keys 13 thereby enabling key assembly 17 to slide axially along a short stroke. Locking keys 13 can thus be at the top edges of apertures 18 (FIGS. 5A and 5B) or else at the bottom portions thereof (FIG. 2).

Figures 5A, 5B, 5C, 5D, 5E:
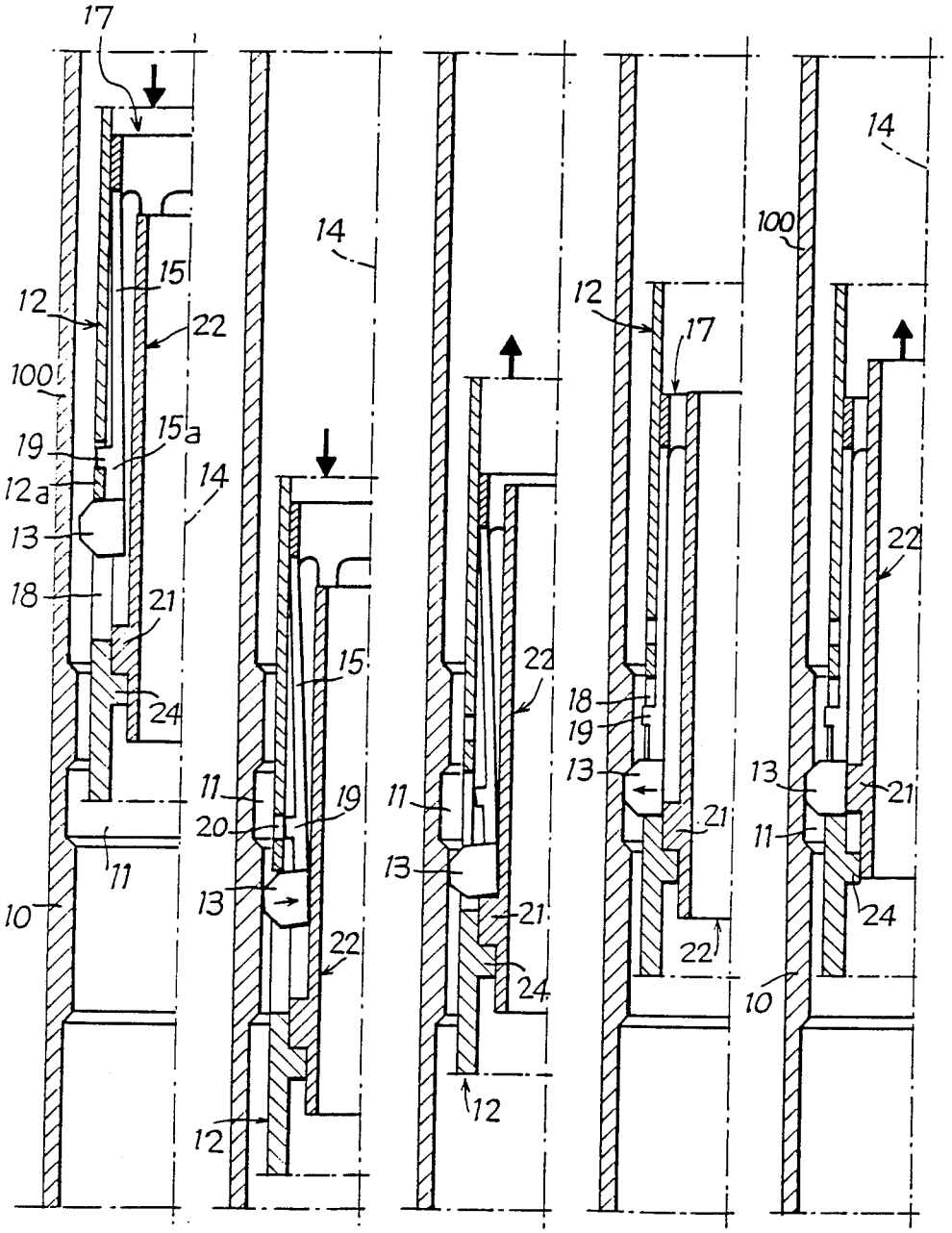
FIGS. 5A to 5E are left-side, longitudinal sections of the locking device of the present invention shown in various stages of operation.

As shown in FIG. 5A, when the locking keys are at the top edge of apertures 18, the stud engages orifice 20, located above corresponding aperture 18. While studs 19 are engaged in orifices 20, key assembly 17 is fixed and its keys are at the top edges of apertures 18. The keys are retracted towards axis 14 by virtue of portion 15*a* of rib 15*s*. Portions 15*a* constitute abutment elements which abut portions 12a of tubular body 12.

In contrast, as shown with reference to FIG. 2, when the locking keys are at the bottom portion of apertures 18, the locking keys move radially away from axis 14 due to the resilient force generated by ribs 15, thereby becoming engaged in peripheral groove 11 of anchor seat 10, locked in place by abutment 21 of sleeve 22 placed coaxially inside key assembly 17 and movable in translation along axis 14. Discussion is now directed to the key engagement mechanism, which includes abutments 21 and notches 23 on sleeve 22, as well as the mechanism which causes sleeve 22 to translocate.

Figures 4A, 4B, 4C:
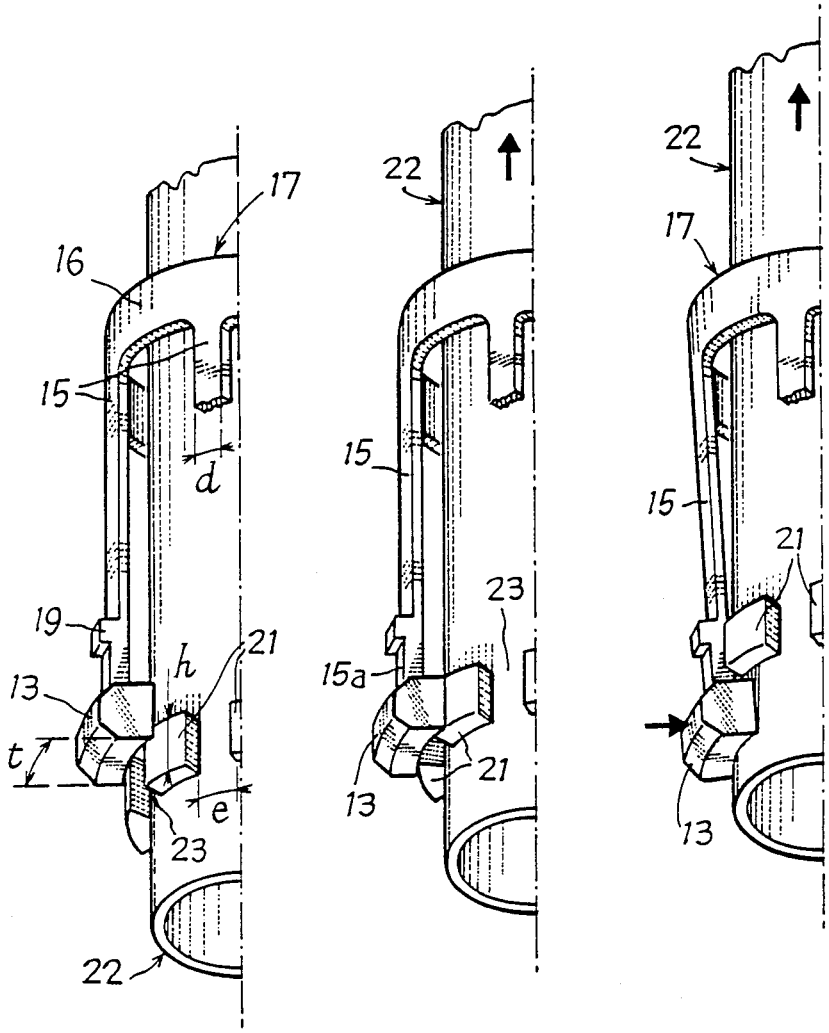
FIGS. 4A to 4C are perspective views of the key assembly of FIG. 3 with an abutment sleeve of the key engagement mechanism, shown in various relative positions.

The structure and operation of abutments 21 are explained with reference to FIGS. 4A through 4C. The set of abutments 21 constitutes a ring projecting from the periphery of sleeve 22, and this ring is interrupted by notches 23. The width e of notches 23 is less than the width t of keys 13 but greater than the width d of ribs 15 (these widths are "circumferential" widths, i.e. widths measured as circles centered on axis 14). FIG. 4A shows abutments 21 partially engaged behind keys 13 thereby preventing the keys from moving inwards. By applying an upward translation movement to sleeve 22, abutments 21 are moved to support keys 13 over their entire axial height h which is substantially equal to the height of the keys (FIG. 4B). Further translation moves abutments 21 above the keys (FIG. 4C). The keys, no longer supported by abutments 21, are pushed towards axis 14. The keys retract radially towards the body of the tool with ribs 15 engaging in notches 23 as they deform elastically (FIG. 4C). A device (not shown) is provided for guiding sleeve 22 to prevent it from rotating about the axis thereby keeping notches 23 in line with ribs 15.

Optionally, keys 13 may be unlocked (placed radially towards sleeve 22) by displacing sleeve 22 downwardly placing abutments 21 fully beneath keys 13. In this option, the abutments could be a continuous ring since notches 23 would not be necessary. In another option, the width of notches 23 could be greater than the width of keys 13 and would be disposed at the same location as the keys. It would then be possible to rotate sleeve 22, thereby placing keys 13 in notches 23. In this case, the device (not shown) for guiding sleeve 22 would enable it to rotate at least through a limited angle about axis 14.

The operation of the locking device is now described with reference to FIGS. 5A to 5E. During the tool-lowering stage shown in FIG. 5A, keys 13 are held at the top edges of apertures 18 by studs 19 engaged in orifices 20. In this situation, keys 13 are retracted into the body of the tool, thereby causing the keys to emerge slightly but not enough to come into contact with the inside surface of the conduit. The ribs of keys assembly 17 are stressed and at a slight slope towards axis 14. It may also be observed that abutments 21 of sleeve 22 are resting on annular rim 24 projecting inwardly from tubular body 12, with rim 24 being positioned such that abutments 21 are level, in part with the bottoms of apertures 18.

The descent of the tool is stopped when keys 13 have been moved past the groove 11 of anchor seat 10 (FIG. 5B). The keys are then level with the reduced diameter portion of seat 10 situated beneath groove 11. This diameter is such that the keys are pushed towards the axis with ribs 15 bending so that studs 19 are out of orifices 20. It should be pointed out that the keys will operate in the same manner even though the keys have passed below the anchor seat.

The tool can then be raised, leaving the keys initially stationary by virtue of friction against the inside surface of seat 10, after which the keys also rise by being lifted by abutments 21 of sleeve 22, pushed upwardly by inside rim 24 of tool body 12 (FIG. 5C).

When the keys are level with groove 11, they engage in the groove by moving away from axis 14 under the elastic spring force ribs 15. They thus escape from the upwards thrust of abuments 21 and therefore remain stationary until they are again driven upwardly by the bottom edges of apertures 18. Meanwhile, the top portions of abutments 21 have moved radially behind the keys, thus beginning to lock them in the deployed anchoring position (FIG. 5D). This deployment of the keys is not hindered by studs 19 since apertures 18 are preferably tall enough to be able to receive the studs.

Tool locking operations are completed by a small upward translation movement applied to sleeve 22, bringing abutments 21 fully behind keys 13, thereby firmly locking the keys in groove 11 (FIG. 5E).

When it is subsequently desired to release the tool from the anchor seat, upward translation is applied to sleeve 22, thereby bringing abutments 21 above keys 13 (FIG. 4C). The tool can then be moved at will along the conduit since the keys are no longer locked by the abutment. The keys can retract freely into the body of the tool with ribs 15 being received by notches 23.

Two observations may be made relating to the above-described locking mechanism:

First, the device is able to lock a tool only in an anchor seat of appropriate inside diameter. If the diameter of the seat encountered by the tool is too large, the keys are not pushed far enough into the body of the tool to remove studs 19 from orifices 20. Thus, the keys are not released and cannot be deployed in the groove of the anchor seat, regardless of the direction in which the tool is moving.

Second, in order to lock the tool in an anchor seat, the tool must be lowered so that keys 13 are below groove 11, thereby releasing the keys, and must then be raised slightly, thereby causing the keys to be deployed and then locked in the groove. Locking will not occur without this short rising stroke. As a result, while the tool is being lowered to the specific anchor seat, it may pass through any number of anchor seats in which it could be locked, but which it is merely required to pass through.

The method by which the above-mentioned upwards translation movements of the sleeve is obtained, is now explained with reference to FIGS. 6A to 6G.

Figures 6A, 6B, 6C, 6D:
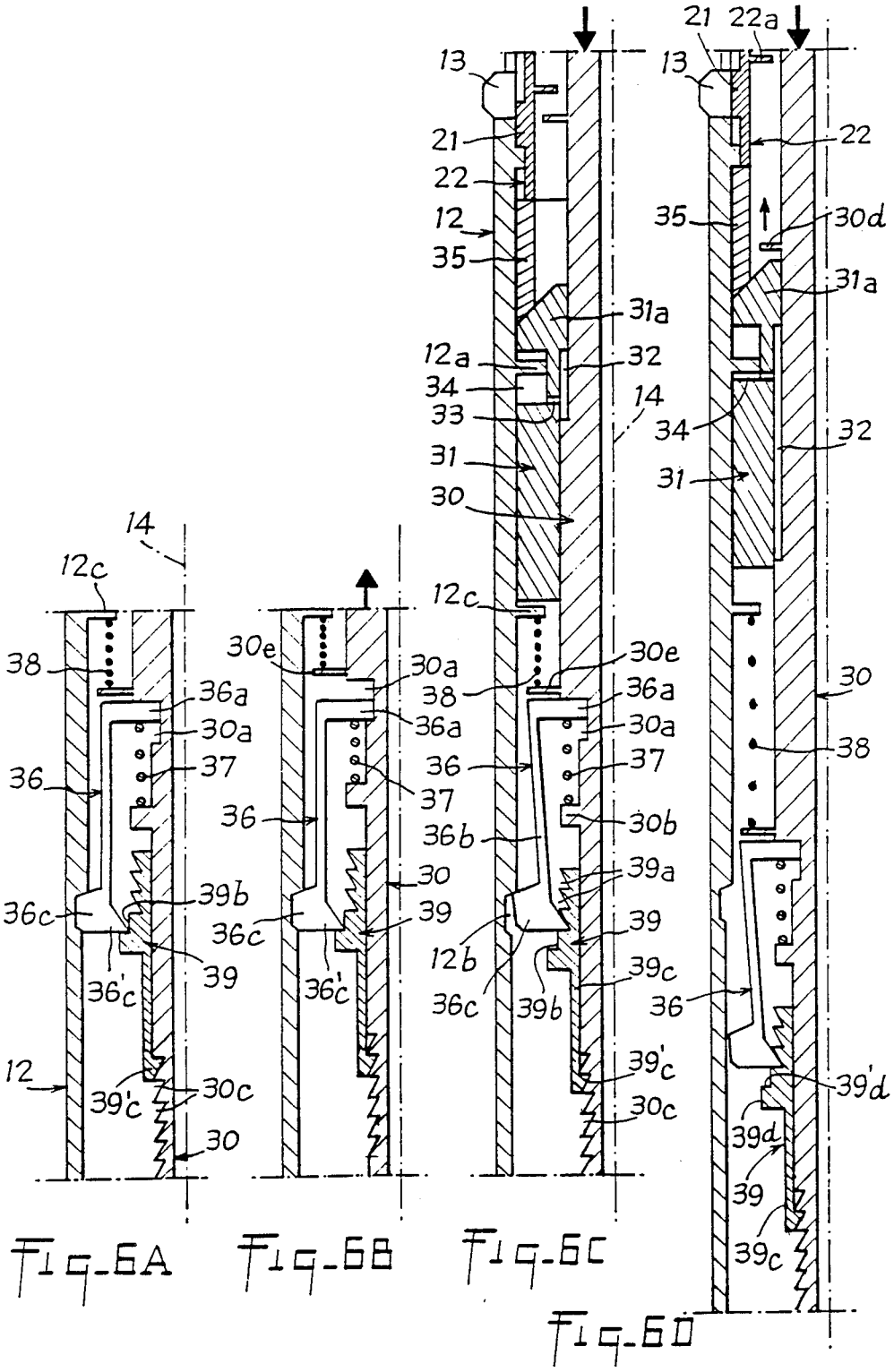
FIGS. 6A to 6G show in a manner similar to FIGS. 5A to 5E those components of the locking device which control locking, unlocking and retraction of the locking keys.
Figure 6E:
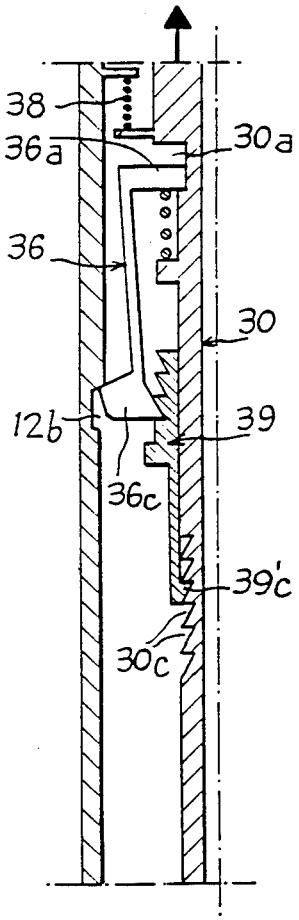
Figure 6F:
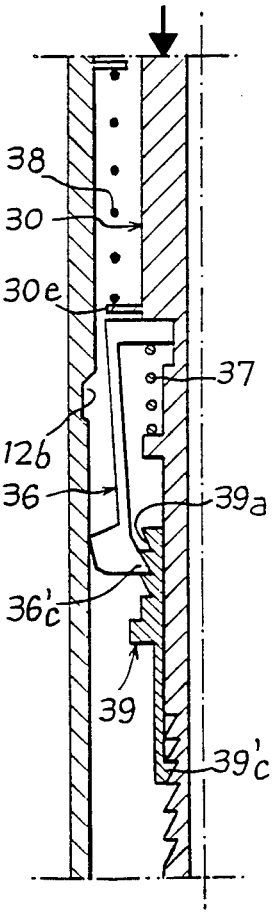
Figure 6G:
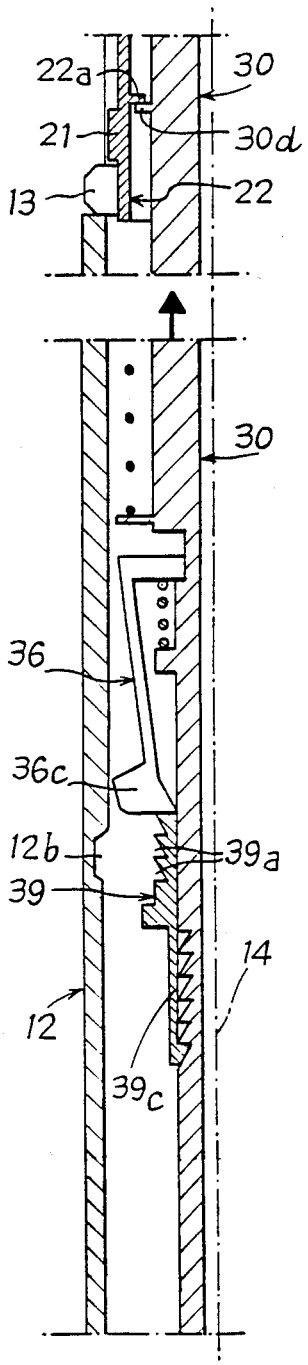

FIGS. 6C and 6D correspond to FIGS. 5D and 5E and similarly show body 12 of the tool, extended key 13, and sleeve 22 which carries abutments 21. The sleeve has long tubular part 30 passing therethrough with the tool suspension cable 76 being fixed thereto. Between part 30 and body 12, annular part 31 is capable of sliding axially, as can part 30. Part 31 includes valve **31*a* which co-operates with a seat (not shown). It also has a peripheral groove of rectangular section into which there projects annular partition 12*a* of body 12. A narrow sealed annular chamber 32 is disposed between parts 30 and 31 and its volume varies as the parts slide axially relative to each other. This chamber is connected by short radial duct 33 to a second sealed chamber 34 formed in the above-mentioned groove in part 31 and delimited by the fixed partition 12*a*. The two chambers 32 and 34 and duct 33** are filled with hydraulic liquid.

Between valve **31*a* of part 31 and sleeve 22 there is tubular member 35 suitable for communicating upward displacement of part 31 to sleeve 22**.

Below part 31, part 30 is surrounded by part 36 similar to part 17 and comprising set of ribs 36b which are integral with annular base **36*a* and which extend substantially parallel to axis 14 with a tendency to move resiliently closer thereto. Each rib 36*b* is terminated by key 36*c* which is suitable, when the rib is forced away from axis 14, for coming into engagement with groove 12*b* provided on the inside face of the body. The inside diameter of the body below groove 12*b* is smaller than the inside diameter above the groove, such that each key 36*c*** is capable, when taking up an intermediate radial position as defined below, of escaping downwardly from the groove, but not upwardly.

Annular base **36*a* of part 36 is engaged in groove 30*a* provided on the outside of part 30. This groove extends axially over a slightly greater distance than the thickness of base 36*a* such that part 36 is capable of moving a short distance axially relative to part 30. It is urged upwardly by a compression spring 37 interposed between base 36*a* and collar 30*b* belonging to part 30. As for part 30, it is urged downwardly by compression spring 38 interposed between collar 30*e* on part 30 above groove 30*a*, and collar 12*c* of the body 12**.

Each key 36c is capable of bearing via an axially directed tooth **36'*c* included thereon against crenelated sleeve 39 including a series of annular catches 39*a* extending axially upwardly from annular zone 39*b* whose outside diameter is slightly greater than the outermost diameter of annular catches 39*a*. Zone 39*b* is delimited downwardly by annular shoulder 39'*d* constituted by second annular zone 39*d* of even larger diameter. Beyond second annular zone 39*d*, sleeve 39 has set of ribs 39*c* extending substantially parallel to axis 14 and urged towards the axis by their elasticity. Each rib 39*c* terminates in tooth 39'*c* engaged with one of a set of annular catches 30*c* disposed along the outer surface of part 30. Teeth 39'*c* and catches 30c are preferably triangular so that sleeve 39 can slide downwardly over part 30 with its teeth 39'*c* skipping from catch 30*c* to catch 30*c* but not capable of sliding upwardly. As for teeth 36'*c* and catches 39'*a*, they too are preferably triangular in shape such that keys 39*b* are capable of moving upwardly relative to sleeve 39 by jumping from catch 39*a* to catch 39*a***, but not capable of moving downwardly.

Initially (FIG. 6A), keys **36*c* of part 36 are fully engaged in groove 12*b* and are kept away from the axis by their teeth 36'*c* resting on annular zone 39b of sleeve 39, while keys 39'*c* of resilient ribs 39*c* are engaged in the top catch of the series of catches 30*c* of part 30. Part 36 is thus fixed inside body 12 of the tool with its base 36*a* being urged by spring 37 into a high position in groove 30*a* of part 30, and with spring 38** being in compression.

When traction is exerted on cable 76 (FIG. 6B), part 30 is raised by a distance equal to the clearance allowed for base **36*a* of part 36 in groove 30*a* (equal to the pitch of catches 30*c* and 39*a* and to the width of zone 39*b*), thereby compressing spring 37. Since sleeve 39 cannot move upwardly, its teeth 39'*c* skip into second catch 30*c***.

When traction on cable 76 ceases (FIG. 6C), the part 30 moves downwardly by virtue of springs 37 and 38, and move initially through the above-mentioned distance together with sleeve 39. As a result, teeth **36'*c* of part 36 leave zone 39*b* and fall into bottom catch 39*a*. Keys 36*c* then take up the above-mentioned intermediate position such that they are capable of leaving groove 12*b* downwardly, thereby enabling part 36 and consequently part 30 to move further downwardly as spring 38 expands (FIG. 6D). As part 30 moves downwardly, the volume of chamber 32 is increased and the volume of chamber 34 is reduced by the same amount, thereby raising part 31 whose valve 31***a* pushes sleeve 22 by means of tubular member 35 so that abutments 21 move behind keys 13. The tool is now securely locked in the conduit.

When traction is again applied to cable 36, part 30 is raised, thereby compressing spring 38 which will cause part 30 to move back down again when traction is released. In each of such traction and release cycles, part 31 is actuated by the set of hydraulic chambers 32 and 34, together with valve 31*a*. However, on each traction (FIG. 6E), the rising displacement of part 30 is limited by the bottom edge of groove 30*a* coming into abutment against base 36*a* of part 36 which is stopped in its upwards movement by keys 36*c* coming into abutment against the top edge of groove 12*b*, thereby causing teeth 39'*c* of sleeve 39 to skip one catch 30*c* downwardly. Then, when cable 37 is released (FIG. 6F), the previously compressed spring 38 expands, thereby lowering part 30, sleeve 39 and part 36, and spring 37 also expands, thereby causing teeth 36*c* of part 36 to skip one catch 39*a* upwardly.

After a given number of traction and release cycles of cable 36, the next release causes teeth 36'*c* to escape from top catch 39*a* of part 39 (FIG. 6G), so that keys 36*c* move a little closer to axis 14 and can then escape upwardly from groove 12*b*. During the last traction operation, the stroke of part 30 is thus no longer limited and its increased amplitude enables it to drive sleeve 22 upwardly by any appropriate means such as two collars 30*d* and 22*a* respectively fixed to the 30 and to sleeve 22, with collar 30*d* raising the sleeve by means of its collar 22*a*. Keys 13 are then retracted towards axis 14 (see FIG. 4C) into body 12 of the tool so that the tool is unlocked and may be raised up the conduit.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What we claim as our invention is:

1. A locking device for controllably securing a tool to an anchor seat located in a conduit of a well, the anchor seat including a peripheral groove having an internal diameter less than the internal diameter of the well conduit and a first predetermined height, the tool including an external tubular body having at least one orifice having a second predetermined height and at least a pair of apertures having a third predetermined height, the third predetermined height being greater than the first predetermined height, said locking device located inside the tubular body of the tool and comprising:

a cylindrical sleeve translocatable in the interior of the tool;

an annular base located between said cylindrical sleeve and the external tubular body of the tool;

at least a pair of locking keys having a height substantially equal to the first predetermined height, each locking key resiliently attached to said annular base by a resilient rib, each locking key being radially translocatable, relative to said cylindrical sleeve;

at least one stud having a height substantially equal to the second predetermined height, said stud located on a rib between said annular base and a locking key, said at least one stud initially located in the oriface urging said locking key, attached to said rib on which said stud is located, radially towards said cylindrical sleeve, preventing said locking key from becoming engaged in the peripheral groove of the anchor seat;

key engagement means for translocating said cylindrical sleeve, said translocation urging said ribs radially away from said cylinderical sleeve, urging said locking keys radially away from said cylindrical sleeve, causing said locking keys to be engagable in the periphiral groove of the anchor seat through the aperture of the tubular body when said locking keys are aligned with said peripheral groove.

2. The locking device of claim 1, said key engagement means including:

at least a pair of abutments located on said cylindrical sleeve, said abutments substantially positioned to contact said pair of locking keys upon translocation of said cylindrical sleeve; and at least a pair of notches separating said abutments.

3. The locking device of claim 1, said key engagement means including:

at least two pairs of abutments located on said cylindrical sleeve, each pair of abutments separated from each other by a distance at least as wide as the width of said ribs, said pair of abutments substantially positioned to contact said pair of locking keys upon translocation of said cylindrical sleeve.

4. The locking device of claim 1, said key engagement means including an abutment ring located along the circumference of said cylindrical sleeve, said abutment ring to contact said pair of locking keys upon translocation of said cylindrical sleeve.

5. A locking mechanism for locking a well tool in a well conduit, the conduit including an anchoring seat having an internal restriction and a groove, the tool including a tubular body provided with radial apertures, said locking mechanism comprising:

a plurality of keys capable of emerging from the body through the apertures, thereby engaging the groove, said keys being radially movable relative to the axis of the body and also axially movable in its corresponding aperture between a high position and a low position;

resilient means for urging said keys into engagement with the groove;

retaining means for holding said keys in the high position, said high position being the radially retracted position of said keys, said keys being released when at least some of the keys are urged towards the axis of the body, followed by an axial displacement of the keys towards their low position; and mobile abutment means for radially locking said keys in engagement with the groove.

6. The locking mechanism according to claim 5, wherein said keys move together in translation along the direction of the axis of the tool.

7. The locking mechanism according to claim 6, wherein said retaining means comprises respective abutment elements bearing against the wall of the tool body above said apertures when said keys are in their high position, thereby holding said keys in the retracted position, at least some of said abutment elements including a stud, said stud retaining the corresponding key in the retracted position when engaged in a suitable orifice provided in the wall of the tool body, and being capable of being dislodged therefrom to release said key.

8. The locking mechanism according to claim 7, wherein said abutment elements and the stud associated with said key are sufficiently close thereto for the corresponding aperture to receive the abutment elements and the stud when said key is released and takes up its low position.

9. The locking mechanism according to claim 8, wherein said mobile abutment means is capable of taking up, by axial displacement, a preliminary locking position in which it partially overlaps the area of the corresponding aperture in the vicinity of the bottom edge thereof so as to provide partial backing against said abutment for said key when said key is in the low position, and a final locking position in which said key is fully backed against said abutment.

10. The locking mechanism according to claim 9, wherein said mobile abutment means are carried on a moving sleeve disposed coaxially inside the body of the tool.

11. The locking mechanism according to claim 10, wherein said mobile abutment means are interconnected to form a continuous ring.

12. The locking mechnism according to claim 10, wherein said mobile abutment means are separate and each extends circumferentially by an amount which is less than a gap between said keys.

13. The locking mechanism according to claim 5, wherein said keys are carried by resilient ribs extending along the axial direction of the tool.

14. The locking mechanism according to claim 13, wherein said resilient ribs carrying said keys are narrower than said keys, said mobile abutment means having a central notch running parallel to the axis and suitable for receiving said resilient ribs of the corresponding key, but not said key.

15. The locking mechanism according to claim 14, wherein said keys are symmetrically distributed about the tool body.

* * * * *